United States Patent [19]

Sandberg

[11] 4,344,468

[45] Aug. 17, 1982

[54] PROCESS AND APPARATUS FOR PACKAGING

[75] Inventor: Harry W. Sandberg, Wilmington, Del.

[73] Assignee: E. I. Du Pont de Nemours and Company, Wilmington, Del.

[21] Appl. No.: 248,346

[22] Filed: Mar. 27, 1981

Related U.S. Application Data

[62] Division of Ser. No. 45,960, Jun. 6, 1979, Pat. No. 4,308,710.

[51] Int. Cl.[3] ..... B65B 1/28

[52] U.S. Cl. ..... 141/69; 141/114; 141/285; 141/314

[58] Field of Search ..... 53/433, 434, 459, 469, 53/400, 403, 511, 512, 570; 141/1, 66, 70, 316, 317, 10, 11, 69, 93, 114, 285, 313–315

[56] References Cited

U.S. PATENT DOCUMENTS

| | | | |
|---|---|---|---|
| 2,532,871 | 12/1950 | Wagner | 18/56 |
| 3,149,649 | 9/1964 | Hix | 141/93 |
| 3,298,156 | 1/1967 | Lerner | 53/29 |
| 3,486,295 | 12/1969 | Rausing et al. | 53/89 |
| 3,879,917 | 4/1975 | Bassendale et al. | 53/28 |
| 4,096,894 | 1/1978 | Gay | 141/93 |

*Primary Examiner*—Frederick R. Schmidt

[57] ABSTRACT

An apparatus for packaging products such as dusty powders are provided. The apparatus is an enclosed housing (e.g., a glove box) with an open lower end and having two glove openings with gloves attached, an opening for attaching a waste disposal bag thereto, and an optional opening for attaching a bag for product samples. The glove box has means for securing a bag in a filling position around the lower end and has the discharge end of a product fill pipe extending into the open lower end. There are vacuum means for applying a vacuum to the inside of the glove box and for applying a vacuum from the inside through apertures circumferentially arranged around the lower edge of the glove box.

10 Claims, 9 Drawing Figures

$H_2O$
$N_2$
$D_1$
$D_2$
Pv
Pa
Pc
hv
hc

PROCESS AND APPARATUS FOR PACKAGING

CROSS-REFERENCE TO RELATED APPLICATION

This application is a divisional application of copending application Ser. No. 045,960, filed June 6, 1979 now U.S. Pat. No. 4,308,710.

DESCRIPTION

Technical Field

This invention relates to apparatus for packaging and more particularly to apparatus for packaging dusty, hygroscopic, or easily oxidized powders.

Background Art

The packaging of toxic or hazardous materials, especially dusty powders or vaporous liquids, presents environmental problems with respect to both air pollution and operator contact. In many cases, the vapor or dust fills the surrounding air making it necessary to install blowers, scrubbers, dust collectors and the like in order to minimize pollution. The packaging operator in such an environment is required to wear a respirator and apparel to maintain his personal safety. Thus, the elimination or minimization of dust or vapor from the environment surrounding the packaging operation is desirable both environmentally and from an operator safety point of view.

Disclosure of the Invention

According to the present invention, there is provided a bag-filling apparatus comprising, in combination: (a) a housing having an open lower end, a side portion and a top portion, said side portion having three openings therein, and a plurality of apertures circumferentially arranged around the side portion adjacent the lower edge; (b) a pair of gloves attached to two of the openings in said side portion, the third opening adaptable for attaching a bag thereto; (c) means for securing a bag in a filling position around the open lower end, said means circumferentially disposed around the housing below the three openings and above the apertures; (d) a product fill pipe extending into the housing and having a discharge end extending into the open end of the housing; (e) means for applying a vacuum to the interior of the housing; and (f) means for applying a vacuum through the apertures from inside said housing.

BRIEF DESCRIPTION OF THE DRAWINGS

FIGS. *5a–5d* are a schematic series of drawings illustrating the operation of the bag-filling apparatus.

BEST MODE INCLUDING A DESCRIPTION OF THE INVENTION

Figure 1:
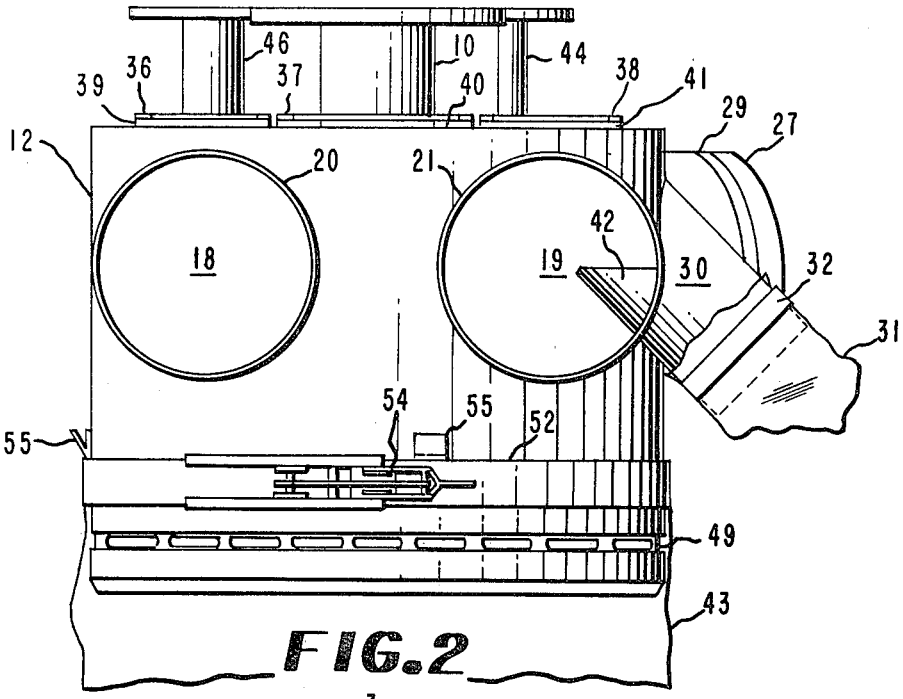
FIG. 1 is an elevation view of a bag-filling apparatus according to the invention.

With reference to the drawings, a product fill pipe 10, having a discharge end 11, extends into cylindrical glove box housing 12 which encloses the fill pipe with a top member 13 and a cylindrical side member 14. The discharge end 11 of fill pipe 10 extends and discharges product into the open lower end 15 of housing 12. Inlet end 16 of fill pipe 10 is flanged and has holes 17 therein suitable for connecting to the discharge end of a typical product storage tank or bin (not shown) which contains, if desired, a conventional product measuring and dispensing mechanism (not shown).

Figure 2:
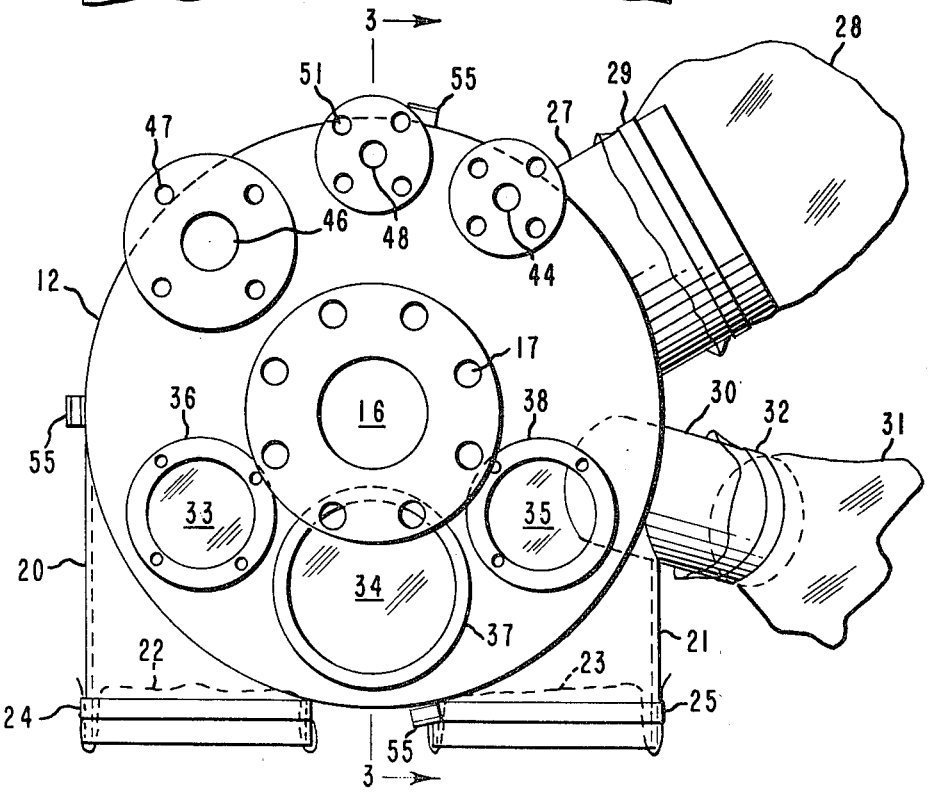
FIG. 2 is a plan view of the bag-filling apparatus of FIG. 1.
Figure 3:
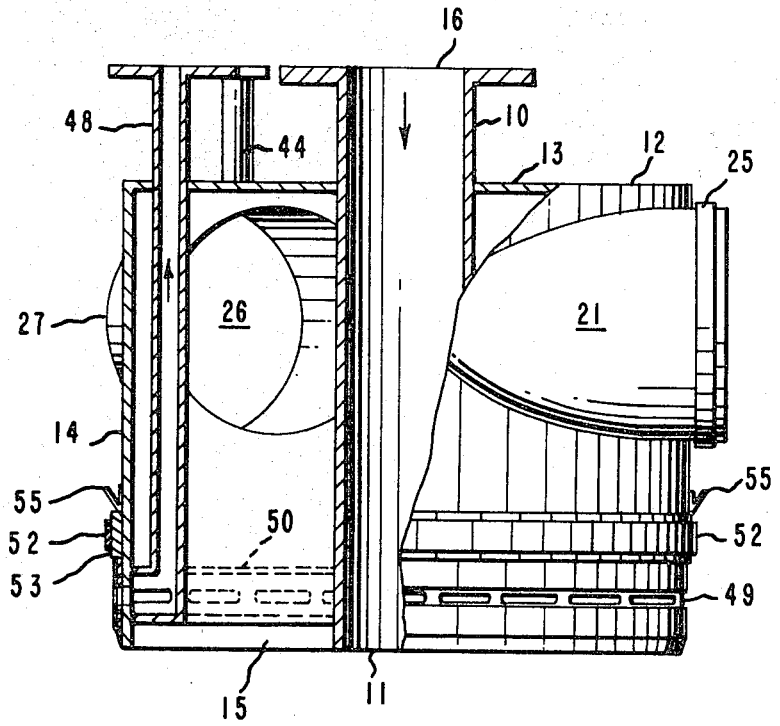
FIG. 3 is a partial cross-sectional view of the bag-filling apparatus taken along line 3—3 of FIG. 2.

Side member 14 has a number of openings therein. Openings 18 and 19 formed by the intersection of horizontal tubes 20 and 21 with side member 14 have rubber gloves extending therethrough into the interior of housing 12. The rubber gloves, the open ends of which are shown in FIG. 2 as 22 and 23, are attached to the ends of tubes 20 and 21 with removable clamps 24 and 25 having underlying elastomeric or rubber strips (not shown) to aid in sealing the clamps against the tubes. A third opening 26 is formed by the intersection of horizontal tube 27 with side member 14. The end of tube 27 is adapted to have the open end of a disposal bag 28, a section of which is shown in FIG. 2, attached thereto by a removable clamp 29. A fourth, optional opening is formed by the intersection of downward sloping tube 30 with side member 14. The outward end of tube 30 is also adapted to have the open end of a sample bag 31, a section of which is shown in FIGS. 1 and 2, attached thereto by a removable clamp 32. The inward end of tube 30 forms a scoop-like portion 42 which makes it easier for an operator to place a sample of product into tube 30 and thus bag 31. Clamps 29 and 32 also have underlying elastomeric or rubber strips (not shown).

Located in top member 13 are optional sight glasses 33, 34 and 35 to aid in the operation of rubber gloves 22 and 23 inside the glove box. The sight glasses are held in place by removable retainer rings 36, 37 and 38, and gaskets 39, 40 and 41.

The primary bag securing means for holding bag 43 in a filling position is metal strap 52 disposed circumferentially around side member 14 of housing 12 below tubes 20, 21 and 27 and above slots 49. Strap 52 is applied and released against underlying elastomeric or rubber strip 53 by clamp 54. Three V-shaped clips 55 are equally spaced around the outer surface of side member 14 to hold strap 52 and clamp 54 in an up position while the open end of bag 43 is being placed around the open lower end 15 of housing 12.

For packaging a powder, a drum 56 such as a standard fiberpak with an oversized polyethylene bag liner is positioned under glove box housing 12 in a filling position on a standard packaging scale 57 which may have electronic circuitry to automatically weigh product and actuate a product feed mechanism (not shown) to product inlet 16 of fill pipe 10. A standard roller conveyor 58 is used to move drum 56 when empty and filled into and out of filling position. The top metal lip of drum 56 is attached to ground 59 during the filling operation.

Extending into top member 13 are lines which provide pressure control within glove box housing 12 when the open end of a bag (partially shown in FIG. 1 and FIG. 4 as 43) is secured around open lower end 15 of housing 12 in a filling position.

Flanged line 48 is a vacuum line through which a vacuum is applied to the inner surface of bag 43 sufficient to engage the bag against the outer surface of the side member 14 of glove box housing 12. Generally, a vacuum of at least 10 inches of water (about 50 inches is sufficient) should be applied. The vacuum is applied through a plurality of slots 49 arranged circumferentially around the lower edge of side member 14 which are in a communicating relationship with manifold 50 connected to vacuum line 48. Manifold 50 is annular in shape and arranged circumferentially around the interior surface of side member 14 opposite slots 49. The flange portion of line 48 contains holes 51 suitable for connecting to a line 62 from vacuum source 63, which is a slot blower which returns air, nitrogen and any dust therein through line 64 back to the glove box through line 46.

Line 46 is for supplying an inert gas such as nitrogen to the interior of the glove box and for returning air, nitrogen and any dust removed through vacuum line 48. When a powder product is being packaged and there is dust in the atmosphere of the glove box, nitrogen reduces any explosion hazard. Nitrogen is optional and is especially so when the product being packaged does not present any explosion hazard. The inlet end of nitrogen and air return line 46 is flanged, the flange having holes therein for securing line 46 to a source of nitrogen 45 and return line 64 shown in FIG. 4.

Line 44 is a vacuum line which is connected to a vacuum source capable of applying a slight vacuum to the inside of the glove box, thus controlling its pressure. The vacuum applied is just sufficient so that any leaks are into the glove box and not so high that bag 43 collapses when it is being filled. Generally, a vacuum is applied so that the pressure within the glove box and bag being filled is about 0–0.5 inch of water less than the outside pressure. As with the other lines, vacuum lines 44 is flanged and has holes 47 therein suitable for connecting a line 65 from the vacuum source to it. Line 69 joining line 65 and feeding into line 44 is connected to U-tube vacuum gauge 70 which shows the pressure differential between the inside and outside of glove box housing 12. Line 69 has a source of $N_2$ 71 connected thereto which bleeds in sufficient $N_2$ to minimize carry-over of dust into the lines and pressure control system. Lines 62 and 65 have connections 75 for flushing the lines.

Figures 4, 6:
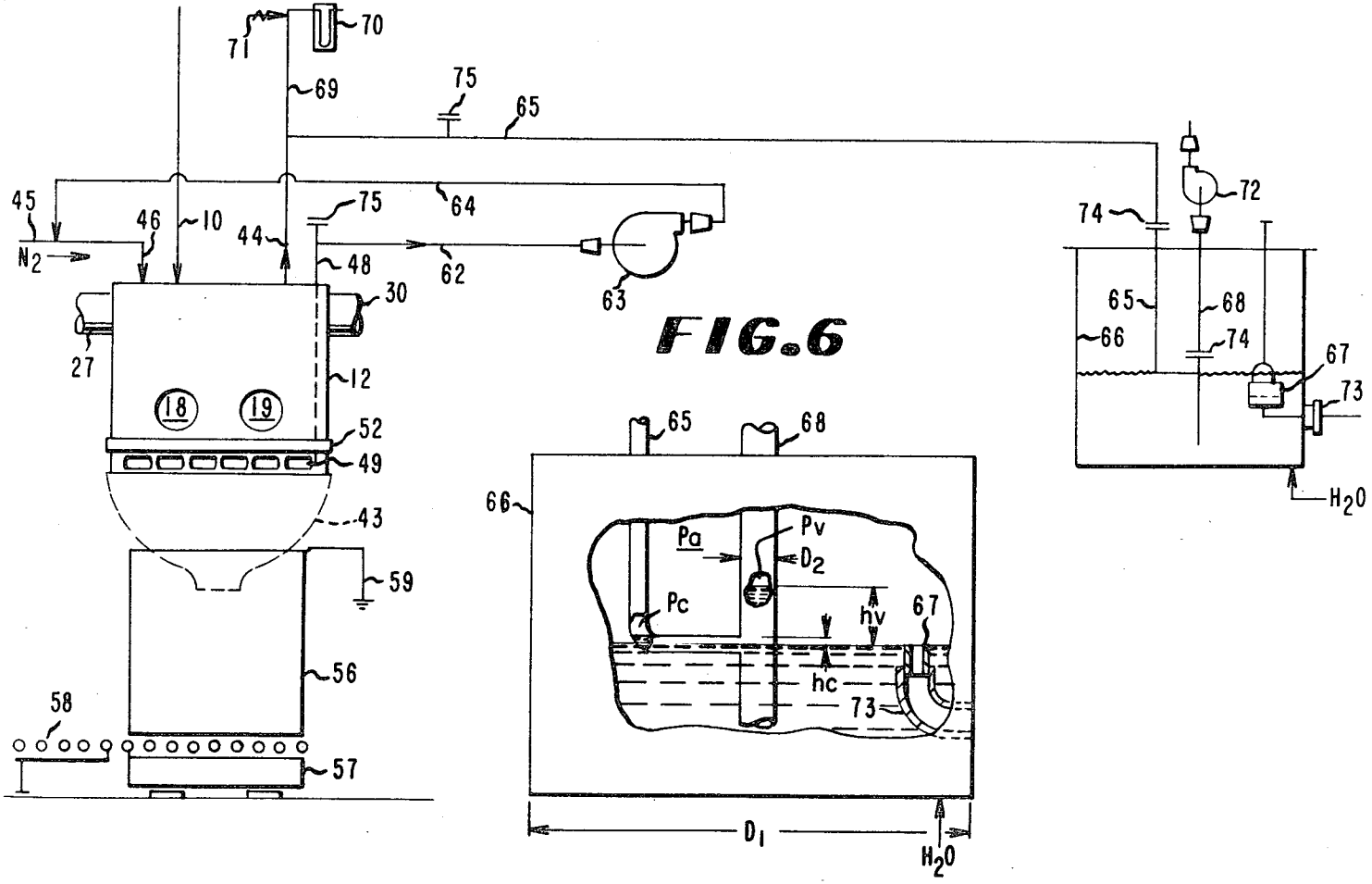
FIG. 4 is a schematic view of the bag-filling apparatus illustrating a pressure control system for the apparatus.
FIG. 6 is an enlarged schematic view of the pressure control system outlined in FIG. 4.

The pressure control system for the glove box outlined in FIG. 4 is shown in more detail in FIG. 6. Glove box and vacuum line 65 pressure ($P_c$) is controlled by adjusting the water level ($h_c$) in container 66 of diameter $D_1$ using an adjustable wier 67. A variable pressure vacuum source 72 applies a pressure ($P_v$), which is of a lower absolute pressure than $P_c$, to line 68 of diameter $D_2$ and a column of water is pulled up the line to an elevation ($h_v$) equal to the differential between atmospheric pressure ($P_a$) and $P_v$. With a large ratio of $D_1/D_2$, e.g., 8–10:1, the absolute pressure ($P_v$) and water leg ($h_v$) can vary over a large range with a very small change in water level ($h_c$) which controls the glove box pressure ($P_c$). Any dust carried over in vacuum line 65 is trapped by the water in container 66 and eventually overflows at wier 67 into drain 73 which empties into a sewer or an intermediate dust recovery system. Sieve plates 74 in lines 65 and 68 reduce entrainment and minimize surging.

By way of an example, when a vacuum is applied by vacuum source 72, water will rise in pipe 68 equal to the vacuum pulled. Line 65 from the glove box is connected to pipe 68 at a 90° angle. If the water inlet line 65 is at the level of the water in container 66, then the pressure in the glove box will be zero (i.e., atmospheric pressure). However, if the water level in container 66 is below the water level in line 65 inlet, the pressure in the glove box is directly proportional to this height difference, e.g., if the difference between water level and line 65 inlet is 0.5 inch, then the glove box pressure is 0.5 high $H_2O$ vacuum. The opposite is true if the water level in container 66 is above the water level in line 65 inlet—in this case the difference creates proportional pressure in the glove box, e.g., if the difference is 0.5 inch, then the pressure in the glove box is 0.5 inch $H_2O$ pressure. Water level in container 66 is controlled by adjustable weir 67 which allows excess water to overflow and drain. If additional water is required, it can be added by means of a water inlet. Since weir 67 is adjusted by means of threaded couplings, it can be set at any point to control the vacuum in the glove box to as low as about 0.1 inch $H_2O$.

Figures 5A, 5B, 5C, 5D:
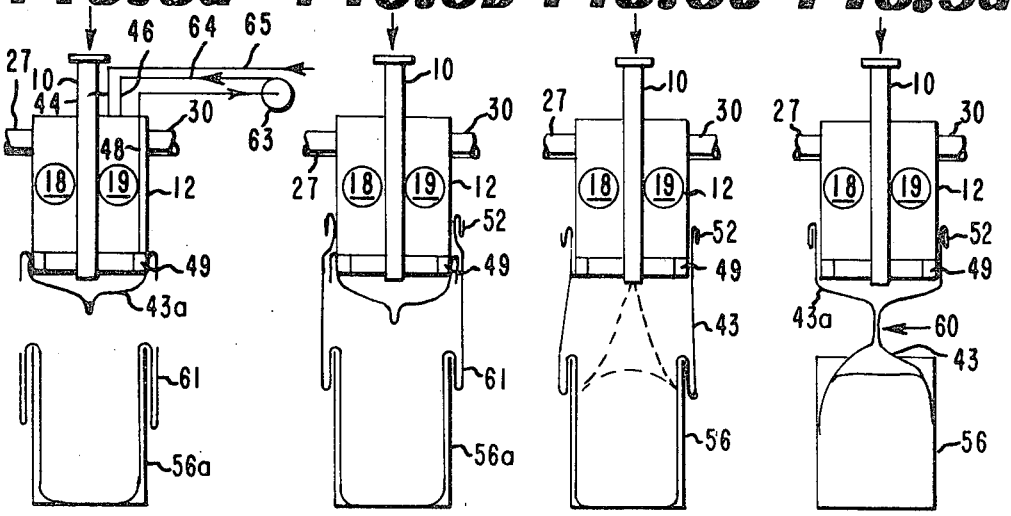

The operation sequence of glove box 12 in the packaging of a product in a bag is schematically shown in FIG. 5. Prior to showing the sequence, drum 56 having an oversized polyethylene bag 43 (or of some other air-impermeable material) is placed under glove box 12. The open end of the bag is placed around the open lower end 15 and held in place with mechanical clamp 54 and strap 52. Since the bag will normally have a larger diameter than the diameter of the glove box, the bag is usually gathered and taped so that it fits snugly against rubber gasket 53 before the clamping action is applied. This is to minimize any air leak into the system at this point and the escape of any product. When a vacuum is applied through slots 49 by vacuum line 48, this vacuum assists in holding the bag in place and removes any product dust that may come up around the outside of the glove box during the bag filling operation. The packaging sequence is now at a point illustrated by FIG. 5*c*, i.e., a product is being discharged into the bag inserted in the drum while the open end of the bag is clamped around the glove box, and a vacuum is applied through the slots to engage the bag against the outer surface of the glove box.

After the bag is filled and product feed shut off, the bag is gathered together at point 60 shown in FIG. 5*d* at a point between the lower end of glove box 12 and the product in the bag. The bag is sealed at this point by wrapping it with an adhesive tape and cutting the bag where taped, and then wrapping the cut end with tape to ensure no product leakage. This creates product in a sealed bag and a sealed bag remnant (shown in FIG. 5*d* as 43*a*) still held in place by clamp 52 and applied vacuum. The filled fiberpak with product in the sealed bag is then removed for shipment and a new fiberpak 56*a* with a new polyethylene bag lining 61 put in the filling position as shown in FIG. 5*a*.

Bag remnant 43*a*, which is still clamped and sealed to the glove box, is removed as follows: The mechanical clamp is released and placed in clips 55 and the top edge of the bag remnant peeled back as shown in FIG. 5*a* to just above vacuum slots 49. At this point, the vacuum applied through slots 49 is holding bag remnant 43*a* on the glove box. Then, the open end of new bag 61 is placed over bag remnant 43*a* and secured to the glove box by mechanical clamp 52 as shown in FIG. 5*b*. The operator then uses rubber gloves 22 and 23 extending into openings 18 and 19 to pull bag remnant 43*a* off the bottom of the glove box and push it through waste opening 26 in tube 27 to which is attached a large, polyethylene waste receptacle bag 28 used for collecting bag remnants. When bag remnant 43*a* is removed, the vacuum applied through slots 49 pulls new bag 61 into engagement with glove box 12 and the procedure repeats. When waste bag 28 is filled with bag remnants, clamp 29 is released, bag 28 removed for disposal and a new waste bag clamped in place using the same procedure as described for FIG. 5 except a removable clamp such as a rubber band is used to hold a bag remnant in place instead of a vacuum.

Samples of product may be taken for product control by use of optional sample outlet tube 30. When samples are desired, a small polyethylene sample bag 31 is clamped to sample port tube 30 by clamp 32. The operator on a random basis, e.g., every other bag, simply catches some of the product discharged from fill pipe 10 on one of rubber gloves 22 or 23 and places it in the scoop-like portion 42 of sample port tube 30 where it then falls into sample bag 31. Filled sample bag 31 is removed and a new sample bag clamped in place using the procedure described for FIG. 5 and the waste bag.

The apparatus and process of the invention as described above have a number of advantages. The polyethylene bag being filled is itself the major barrier which separates the internal, dusty environment from the room environment and which separates the operator from contact with the material being packaged. In most cases, additional personal protective equipment is not needed. Thus, the invention is particularly useful for packaging toxic or hazardous materials, especially hygroscopic or explosive powders. Also, pressure control, which keeps the bag from swelling or collapsing is simple and easy to operate. When explosive dusts are present, an inert gas can be added easily to maintain an explosion-proof atmosphere. Lastly, the amount of air-/inert gas vented is very small; therefore, entrainment losses, product contamination, inert gas usage and air pollution controls are minimized.

I claim:

1. A bag-filling apparatus comprising, in combination:

(a) a housing having an open lower end, a side portion and a top portion, said side portion having three openings therein, and a plurality of apertures circumferentially arranged around the side portion adjacent the lower edge;

(b) a pair of gloves attached to two of the openings in said side portion, the third opening adaptable for attaching a bag thereto;

(c) means for securing a bag in a filling position around the open lower end, said means circumferentially disposed around the housing below the three openings and above the apertures;

(d) a product fill pipe extending into the housing and having a discharge end extending into the open end of the housing;

(e) means for applying a vacuum to the interior of the housing; and (f) means for applying a vacuum through the apertures from inside said housing.

2. The apparatus of claim 1 wherein the housing has means for supplying and circulating an inert gas.

3. The apparatus of claim 1 wherein the side portion of the housing has a fourth opening therein near the gloves adaptable for removably attaching a bag thereto.

4. The apparatus of claim 1 wherein the housing vacuum means of (e) applies a vacuum sufficient to maintain the bag secured in a filling position in an uncollapsed condition.

5. The apparatus of claim 4 wherein the aperture vacuum means of (f) applies a vacuum sufficient to hold the bag secured in a filling position against the outer surface of the side portion.

6. A bag filling apparatus comprising:

(a) a vertical, substantially cylindrical housing having an open lower end, a side member and a top member, the side member having a plurality of slots arranged circumferentially around the lower edge of the side member;

(b) three substantially horizontally extending tubes intersecting the side member of the housing to form openings therein, the open end of one of said tubes adaptable for removably attaching a waste receptacle thereto;

(c) a rubber glove attached to the open end of two of the tubes and which extend inwardly through each tube into the housing;

(d) clamping means circumferentially arranged around the lower end of the housing below the tubes and above the slots for securing a bag in a filling position around the lower end of the housing;

(e) a product fill pipe having an inlet end and a discharge end, said pipe extending into the housing with the discharge end extending into the open end of the housing;

(f) means for applying a vacuum to the interior of the housing when the bag is in the filling position;

(g) manifold means circumferentially arranged around the interior of the side portion communicating with each of the slots; and (h) a vacuum line coupled to the manifold means and extending through the housing to a vacuum source.

7. The apparatus of claim 6 wherein housing vacuum means (f) applies a vacuum sufficient to maintain the bag secured in a filling position in an uncollapsed condition.

8. The apparatus of claim 6 or claim 7 wherein the vacuum source coupled to manifold means (g) applies a vacuum sufficient to hold the bag secured in a filling position against the outer surface of the side member.

9. The apparatus of claim 8 wherein the housing has means for supplying and circulating an inert gas.

10. The apparatus of claim 9 wherein a fourth substantially horizontal tube intersects the side member near the rubber gloves to form an opening therein, the open end of the tube adaptable for removably attaching a bag thereto for periodically receiving a sample of product discharged from the fill pipe.

* * * * *